US005372470A

United States Patent [19]

Wilke et al.

[11] Patent Number: 5,372,470

[45] Date of Patent: Dec. 13, 1994

[54] LIFT TRUCK

[75] Inventors: Rudeger H. Wilke, Darien; David Floreani, Park Ridge, both of Ill.

[73] Assignee: Savage Bros. Co., Elk Grove Village, Ill.

[21] Appl. No.: 151,739

[22] Filed: Nov. 15, 1993

[51] Int. Cl.[5] ..... B66F 9/12

[52] U.S. Cl. ..... 414/641; 414/422; 414/607

[58] Field of Search ..... 414/422, 446, 490, 607, 414/628, 629, 641, 642; 187/9 R

[56] References Cited

U.S. PATENT DOCUMENTS

| | | | |
|---|---|---|---|
| 2,071,503 | 2/1937 | Dalton | 414/422 |
| 4,069,932 | 1/1978 | Stedman | 414/641 X |
| 4,238,004 | 12/1980 | Olson | 414/629 X |
| 4,940,381 | 7/1990 | Rysewyk | 414/607 X |
| 5,199,533 | 4/1993 | Wilke | 187/9 R X |
| 5,207,550 | 5/1993 | Lehman | 414/607 X |
| 5,288,200 | 2/1994 | Burgers et al. | 414/422 X |

FOREIGN PATENT DOCUMENTS

| | | | |
|---|---|---|---|
| 0808338 | 7/1951 | Germany | 414/641 |

*Primary Examiner*—Michael S. Huppert
*Assistant Examiner*—James W. Keenan
*Attorney, Agent, or Firm*—Paul H. Gallagher

[57] ABSTRACT

A manually movable lift truck having a base with a self-contained power plant therein and a column rising therefrom. The column includes a hollow post with a rotatable featureless shaft therein. A flexible chain has an outer end connected with a lift fork, and runs upwardly and then down into the interior of the post. Miter gears and a sprocket are mounted at the top of the post, and the chain runs over this sprocket. The portion of the chain between the sprocket and lift fork is the only active portion thereof, and the remaining portion remains loose and free.

5 Claims, 1 Drawing Sheet

LIFT TRUCK

CROSS REFERENCE

Copending application of the present inventors, entitled Lift Truck, Ser. No. 08/151,740, filed Nov. 15, 1993.

FIELD OF THE INVENTION

The invention resides in a lift truck, particularly a self-contained, manually movable lift truck, including a power plant.

A principal object of the invention is to provide such a lift truck that is extremely simple, and economical to manufacture, thereby enabling a low-selling price.

Another principal object is to provide such a lift truck with a base having a power plant and a single post with a lift fork on the post, of novel construction providing a compact drive means in the post.

A further object is to provide such a simple lift truck wherein the drive means includes gear means at the top of the post, a sprocket driven by the gear means, and a single-run flexible member driven by the sprocket and having an active end connected with the fork and an inactive end remaining in the post.

BRIEF DESCRIPTION OF THE INDIVIDUAL MEMBERS OF THE DRAWING

DETAILED DESCRIPTION

Figure 1:
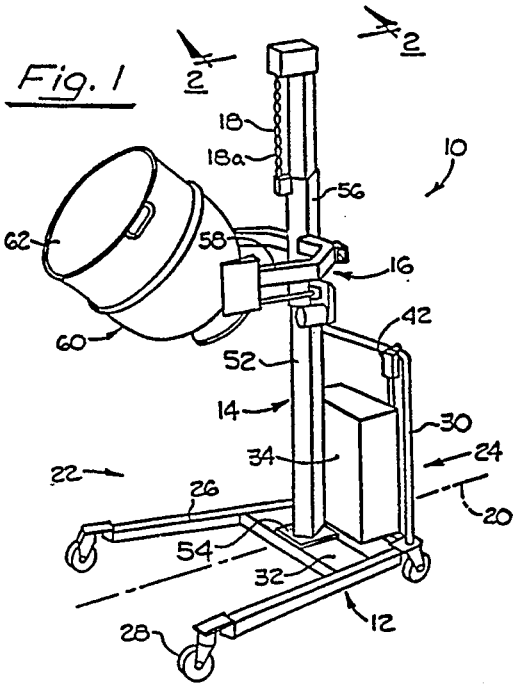
FIG. 1 is a perspective view of the lift truck embodying the features of the invention.
Figure 2:
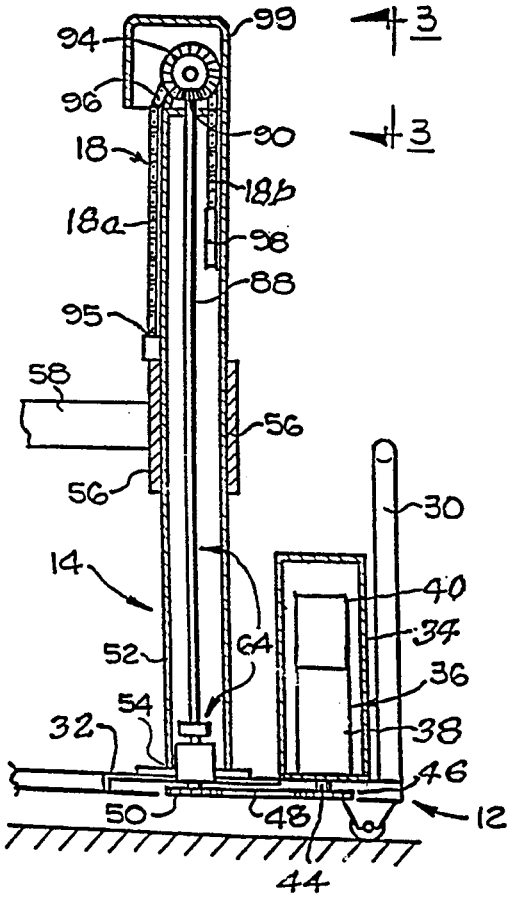
FIG. 2 is a vertical sectional view taken at line 2—2 of FIG 1.
Figure 3:
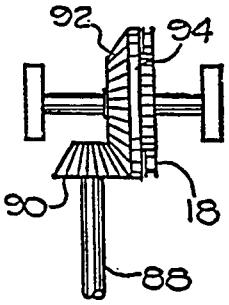
FIG. 3 is a view of the upper end of the drive transmitting means oriented according to line 3—3 of FIG. 2.

Referring in detail to the drawings, the lift truck of the invention is shown in perspective, in its entirety at 10, in FIG. 1. The lift truck includes three main parts or components, a base 12, a column 14, and a lift fork 16. It also contains a single-run chain or flexible member 18, having an outer end 18*a* connected to the lift fork, and an inner end 18*b*, extending down into the interior of the column. The lift truck is oriented according to a front-to-rear median line 20 indicating a front side 22 and a rear side 24.

The base 12 has a suitable frame 26 on which are mounted casters or wheels 28 for moving the lift truck to different locations. A suitable hand grip 30 is mounted on the base for gripping for manually pushing the lift truck.

The base includes a top platform or plate 32 on which is mounted a casing 34 in the form of a box. The casing contains a power plant 36 for lifting and lowering the fork, providing a self-contained feature. The power plant includes an electric motor 38, and a battery 40 of suitable voltage such as 12 V. Suitable switches and control elements 42 for controlling the drive motor are mounted in a suitable location such as on the hand grip 30.

The drive motor 38 has a drive shaft 44 extending downwardly below the plate 32, the plate being elevated a short distance above the supporting floor. The drive shaft has a drive sprocket 46 on which is trained a toothed belt 48 which is also trained on another sprocket 50 incorporated in the drive transmitting mechanism described below.

The column 14 includes a post 52 rigidly mounted on the base. It is rectangular in cross-section, preferably square, with corners directed front-to-rear along the line 20, for strength in supporting the load on the fork. The post, of steel, is preferably welded to the base plate 32 as indicated at 54 and extends upwardly a suitable distance such as for example 6 feet, 7 feet, 8 feet, etc. Located in the post are certain drive transmitting elements which will be described in detail hereinbelow.

The lift fork 16 includes a sleeve 56 slidable on the post and lifting arms 58 extending forwardly and spaced apart, and arranged for swivelly mounting a mixing bowl 60 in which is placed a tub 62. The use of the lift truck with respect to the mixing bowl and tub, is known, i.e. a quantity of mix is placed in the tub, the lift truck pushed to another location, and the tub is emptied by tilting it. Suitable means of known kind are used for tilting the mixing bowl, driven by the motor 38, and controlled by the switches 42. The sleeve 56 is freely slidable on the post and may be of any desired specific construction, either as a simple tubular element, or, instead, one having slide pads of the kind covered by U.S. Pat. No. 5,199,533. The outer end 18*a* of the chain 18 is connected to the fork, and this connection is preferably made directly with the upper end of the sleeve 56.

It will be noted that a single post is utilized, containing and supporting the driving means and the fork.

The drive transmitting means in the post is indicated in its entirety at 64, and includes a drive shaft 88 having the sprocket 50 on its lower end driven by the belt 48. The drive shaft is a simple rod having a miter gear 90 at its top, which meshes with another miter gear 92 on a sprocket 94 over which the chain 18 is trained at an intermediate point of the latter. The miter gears and sprocket are exterior to the post. The outer end 18*a* of the chain is secured at 95 to the sleeve 56 and thus to the fork, and the inner end 18*b* of the chain is extended down into the interior of the post. An inclined piece 96 is secured to the top of the post, over which the outer run of the chain rides, and a suitable keeper is provided over the sprocket to keep the chain on the sprocket. The inner end of the chain is loose and unattached and hangs freely in the interior of the post. A weight 98 is attached to the inner end of the chain to keep it in straight down condition. The active portion of the chain is only that portion between the sprocket and the fork, also referred to as the outer portion, and the remaining, or inner portion, is inactive, and the post thus serves as a means for confining that inactive portion.

Preferably, a cap or casing 99 is mounted on the post at the top, enclosing the exposed movable elements, including the sprocket, the miter gears 90, 92 and the corresponding portion of the chain. Brake means of suitable kind may be utilized for holding the load, such as high ratio gearing, or a locking element positively blocking a drive element.

The construction includes advantageous features of simplicity, particularly in the overall small size of the device, especially the column, the extension of the chain into the interior of the post, leaving only that portion from the top of the column down to the fork exposed to the exterior. The cost of manufacture is low, enabling a corresponding relatively low selling price.

That portion of the drive transmitting means in the post is essentially the drive shaft 88 which is a simple rod. The loose inner end of the chain does not act as a driving component, remaining inactive, and the placement of it in the post is a great advantage of simplicity and safety. A further great advantage is the placement of the miter gears and sprocket at the upper end of the post, which are driven by the power plant which is located remote therefrom.

A safety feature of the device of the invention is now referred to, i.e. except for the external exposure of the lift fork and sleeve, which is necessary for functioning of the device, the only other exterior member that is movable is the chain 18, and more specifically only that portion of it from the top of the column down to the sleeve 56. The remainder of the chain is in the interior of the post, and thus enclosed. This reduces the danger in handling the lift truck, since the exposed part of the chain is very close to the post and does not extend to any appreciable extent away from the post, providing a great safety factor. Other moving parts are enclosed, i.e. the sprockets and belt, these latter members being effectively enclosed by the plate 32.

We claim:

1. A lift truck comprising a base having wheels for movement thereof, a single hollow post on the base, the post being essentially square, and being circumferentially continuous, a load carrying fork mounted on the exterior of the post, and slidable thereon and carried thereby, a drive motor on the base, and drive means interconnecting the drive motor and the fork, the drive means; including as a serial element thereof, a single run flexible member having an outer portion extending downwardly from an upper end of the post at an exteriorly of and closely adjacent to the post and connected with the fork, connected at an intermediate point with a fixed element of the drive means which is located exterior of and longitudinally in line with the post, and having its inner end portion unconnected.

2. A lift truck according to claim 1 wherein, the drive means includes a rotatable shaft in the post, the fixed element of the drive means includes a sprocket operably connected to the rotatable shaft, the flexible member is connected as stated, with the sprocket, and has its inner end portion confined in the post.

3. A lift truck according to claim 2 and including, a cap on the post covering the upper end thereof and having a bottom opening laterally of the post.

4. A lift truck according to claim 2 wherein, the portion of the drive means that is in the post consists essentially only of a featureless vertical shaft.

5. A lift truck according to claim 2 wherein, the fixed element includes miter gears, one of the miter gears being mounted on the shaft and a second being mounted on the post on a horizontal axis, and the sprocket is mounted to the second miter gear and thereby on a horizontal axis.

* * * * *